United States Patent [19]

Ruesch

[11] 4,184,329

[45] Jan. 22, 1980

[54] DEVICE FOR CONNECTING AN EXHAUST MANIFOLD THROUGH THE CYLINDER HEAD OF A MULTI-CYLINDER INTERNAL COMBUSTION ENGINE

[75] Inventor: Peter Ruesch, Rorschacherberg, Switzerland

[73] Assignee: Aktiengesellschaft Adolph Saurer, Arbon, Switzerland

[21] Appl. No.: 842,315

[22] Filed: Oct. 14, 1977

[30] Foreign Application Priority Data

Oct. 14, 1976 [CH] Switzerland ..... 13004/76

[51] Int. Cl.[2] ..... F01N 7/18; F01N 7/10

[52] U.S. Cl. ..... 60/322; 60/323

[58] Field of Search ..... 60/322, 323

[56] References Cited

U.S. PATENT DOCUMENTS

| | | | |
|---|---|---|---|
| 1,828,774 | 10/1931 | Godward | 60/323 |
| 2,635,418 | 4/1953 | Leach | 60/323 |
| 2,952,344 | 9/1960 | Pope | 60/323 |
| 3,374,775 | 3/1968 | Ferguson | 60/323 |
| 3,716,992 | 2/1973 | Stahl | 60/323 |
| 3,798,903 | 3/1974 | Mitchell et al. | 60/323 |

*Primary Examiner*—Robert E. Garrett

*Attorney, Agent, or Firm*—Ostrolenk, Faber, Gerb & Soffen

[57] ABSTRACT

In a multi-cylinder, in-line, internal combustion engine, the cylinder head has a plurality of exhaust ports, and these ports are connectable to the inlet pipe sockets of an exhaust manifold; the exhaust manifold has a respective attaching flange at each exhaust port for attaching the exhaust manifold to the cylinder head; compression straps stretch over the flanges; securement screws pass through the compression straps and through the flanges into the cylinder head; each flange having a pair of spaced apart fork lugs, between which its screw passes; these give lateral play to the respective flange which absorbs the thermal expansion and contraction of the manifold with respect to the cylinder head.

The present invention relates to a device for connecting an exhaust manifold with the cylinder head of a multi-cylinder, usually in-line, internal combustion engine.

11 Claims, 2 Drawing Figures

DEVICE FOR CONNECTING AN EXHAUST MANIFOLD THROUGH THE CYLINDER HEAD OF A MULTI-CYLINDER INTERNAL COMBUSTION ENGINE

BACKGROUND OF THE INVENTION

A cylinder head of an internal combustion engine contains the cylinder or cylinders. The cylinder head has a respective exhaust port from each cylinder. Each such port communicates with a common exhaust manifold for the engine. The exhaust manifold includes inlet pipe sockets that are connected to the exhaust ports from each cylinder in the cylinder head. The exhaust manifold is considerably heated by the exhaust gases passing through it. The cylinder head, on the other hand, is kept relatively cooler by appropriate cooling means provided therein.

Typically, an exhaust manifold is fastened by appropriate fastening means to the cylinder head from whose cylinder that exhaust manifold is fed. However, fastening of the exhaust manifold to the cylinder head of a multi-cylinder internal combustion engine is difficult. This arises in part because of the different rates of thermal expansion of the exhaust manifold and of the cylinder head. It does not matter whether there is a single exhaust manifold for several cylinders that are in a single cylinder head or whether there is a single exhaust manifold for an engine having a respective individual cylinder head for each cylinder. The different rates of thermal expansion result from the large difference in temperature between the generally uncooled exhaust manifold and the generally cooled common cylinder head or the generally cooled crankcase in the situation of an individual cylinder head containing only an individual cylinder. The different rates of thermal expansion may cause warping of the exhaust manifold and/or of the pipe sockets of the exhaust manifold which communicate with the exhaust ports from the cylinder head. It may even lead to cracks or breaks developing in the exhaust manifold or its pipe sockets. It may also lead to the destruction or leaking of the gaskets that are generally installed between the exhaust manifold and the cylinder head at the points of connection therebetween. Further, it also may break the fastening elements by which the exhaust manifold and the cylinder head are connected.

One known solution to the problem of different rates of thermal expansion comprises connecting an elongated resilient transition pipe between the exhaust manifold and the point of connection of that manifold with the cylinder head for elastically taking up the relative distortions resulting from the different rates of thermal expansion. This solution, however, is expensive, increases the weight of the entire connection and of the exhaust manifold assembly and requires a large amount of space in the engine compartment of the vehicle.

SUMMARY OF THE INVENTION

It is the primary object of the present invention to provide a simple, compact, single piece exhaust manifold that is adapted for connection with a cylinder head.

It is another object of the invention to provide such an exhaust manifold and connection therefor to the cylinder head, which is adapted to easily take up the different rates of thermal expansion of the exhaust manifold and the cylinder head.

It is another object of the invention to provide such a connection without any of the above described problems of the prior art.

In accordance with the invention, the pipe sockets that are the inlets of the exhaust manifold are not directly mechanically secured to the exhaust ports from the cylinders in the cylinder head. The exhaust manifold has a respective attachment flange located along the exhaust manifold at each of its pipe sockets. The flanges are adapted to be applied securely and sealingly against the respective connecting surfaces that are located at each exhaust port from the cylinder head. Fastening means hold the flanges to the cylinder head. For each flange of the exhaust manifold, the fastening means comprises at least one and more usually two fastening screws by which the flange is attached to the cylinder head. Each of the two screws is located on a respective opposite side of the exhaust manifold. In the preferred embodiment, each connecting flange on the exhaust manifold terminates in a fork at each side of the exhaust manifold. Each fork is comprised of two laterally spaced apart lugs between which the fastening screw passes as it extends into a receiving hole in the cylinder head. The spacing between the pair of lugs of each fork on each flange provides space required for the lateral shifting and play due to the different rates of expansion of the exhaust manifold and the cylinder head.

A compression strap is overlaid over each pair of fork lugs. In the preferred embodiment, there is a single compression strap along each side of the exhaust manifold, which extends past all of the pairs of fork lugs on that side of the exhaust manifold. Each fastening screw first passes through a respective bore in the respective compression strap and thereafter through the space between the fork lugs of a pair thereof before finally extending into the receiving hole in the cylinder head. The screw is tightened against the compression strap and the compression strap holds the exhaust manifold flange securely against the cylinder head while permitting the lateral play and shifting of the exhaust manifold that is required by the thermal expansion and contraction thereof.

Other objects and features of the invention will be explained with reference to an illustrative embodiment of the invention that is shown in the accompanying drawings.

DESCRIPTION OF A PREFERRED EMBODIMENT

Figure 1:
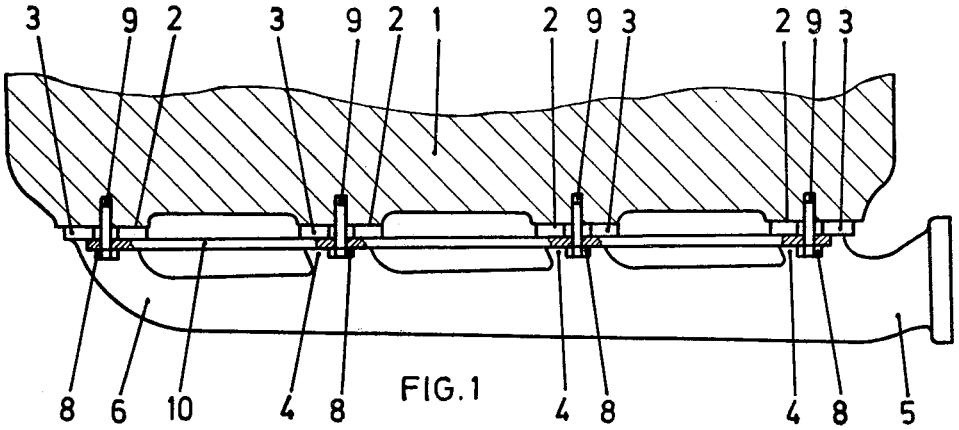
FIG. 1 is a top view of a fastening device according to the invention, shown partially in cross-section and viewed along the line A—A of FIG. 2.
Figure 2:
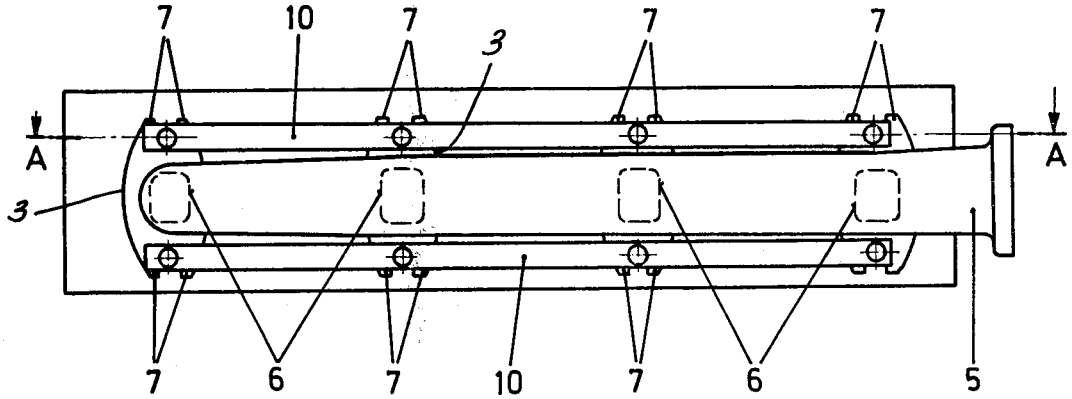
FIG. 2 is a side elevational view of an exhaust manifold having the fastening device shown in FIG. 1.

The cylinder head 1 of the in-line internal combustion engine (engine not shown) is provided internally with four cylinders (not shown) that are arranged in a straight line longitudinally (left and right in FIG. 1) along cylinder head 1. The cylinder head has a plurality of connecting surfaces 2 on one side thereof which are spaced along the length of the cylinder head at intervals corresponding to the respective positions of the cylinders. Each connecting surface 2 serves as a support for a respective connecting flange 3 of a pipe socket 4 which communicates into an exhaust manifold 5. There is a respective exhaust port outlet 6, shown in dashed lines in FIG. 2, from each cylinder and communicating through the respective connecting surface 2 into the respective exhaust manifold pipe socket 4 therefor.

Arrayed along one side of the exhaust manifold 5 is a plurality of pipe sockets 4, each placed to form a continuous pathway with a respective cylinder head exhaust port 6. Each pipe socket terminates in a connecting flange 3. Each flange 3 is placed so that its respective pipe socket 4 passes through it. Each connecting flange 3 extends behind and well past the sides of the generally tubular exhaust manifold 5 to which the flange is attached. At each side edge thereof on the opposite sides of exhaust manifold 5, each flange 3 terminates in a pair of fork shaped lugs 7. Each fork extends deeply enough into flange 3 as to be able to receive a fastening screw 8 between the fork lugs 7. The lugs 7 of each fork are spaced apart far enough to provide for considerable lateral play between the lugs 7 of each fork with respect to relative motion of the respective fastening screw 8 as that screw moves with the cylinder head.

There is a fastening screw 8 applied at each end of each flange 3. Each screw is screwed into threaded receiving holes 9 that are provided for the screws in cylinder head 1. It is apparent that the screws will remain stationary with the cylinder head 1 in contrast with the lateral shifting of the exhaust manifold 5 with respect to the cylinder head. At each connecting surface 2 and for each flange 3, on each side of exhaust manifold 5, one screw 8 secures the respective flange 3 to the cylinder head 1.

At each side of exhaust manifold 5 over the lugs 7, there is a respective compression strap 10. Although a compression strap like strap 10 may extend along the length of exhaust manifold 5 approximately merely the length of a single respective flange 3 or slightly longer than that, in the preferred embodiment, each strap 10 extends the length of the entire array of flanges 3 on its respective side of the exhaust manifold 5. Each strap 10 extends over all of the lugs 7 of all of the flanges 3 along the respective side of the exhaust manifold 5. Each strap engages the lugs 7 on the surface thereof away from the connecting surface engaged by the lugs. Each pressure screw 8 is passed through and is tightened against and tightly squeezes the respective compression strap 10 against the respective lugs 7 of the flange 3. In contrast with the larger space between the lugs 7, the pressure straps 10 have relatively small size bores through them for receiving the fastening screws 8. This permits only a small amount of lateral play of the straps 10 with respect to the pressure screws 8. The distance between a pair of lugs 7 may, for instance, be about twice as great as the diameter of the passage for a screw 8 through the compression strap 10.

The pressure exerted by the screws 8 and/or by the compression straps 10 on the connecting flange lugs 7 should be selected so that the connections between each pipe socket 4 and the respective exhaust port outlet 6 are sealed and so that lateral displacement of the flanges 3 with respect to both the cylinder head 1 and the compression straps 10 is possible without excessive stressing of the pipe sockets 4, the exhaust port outlets 6, the screws 8, the flanges 3 and the exhaust manifold 5. In addition, a gasket (not shown) that is conventionally available on the market and which is capable of withstanding such lateral displacements as are likely to occur, without damage to the gasket, is provided between each flange 3 and the respective connecting surface 2 on the cylinder head 1.

As a result of the straps being on the exterior of the cylinder head and away from the exhaust manifold to some extent, and as a result of the rather small area of contact between the straps 10 and the hot connecting flanges of the exhaust manifold, the compression straps 10 assume an average temperature which is on the same order of magnitude of temperature as the temperature of the cylinder head 1. The straps 10, therefore, do not experience greater thermal expansion than the cylinder head 1. Accordingly, there is practically no shearing force exerted upon the fastening screws 8 by the straps 10, and the relatively smaller bore for the fastening screws through the straps 10 does not result in damage to the screws or the remainder of the apparatus.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A device for connecting an exhaust manifold to cylinder head means of a multi-cylinder internal combustion engine, wherein the cylinder head means includes a plurality of exhaust ports and the exhaust manifold includes a corresponding plurality of pipe sockets, with each of the pipe sockets being placed to communicate with a respective exhaust port, said device comprising:

said exhaust manifold including a plurality of connecting flanges secured to said exhaust manifold and each being at a respective location adjacent to a respective pipe socket; each said flange having at least one pair of lugs defined thereon and said lugs of said pair being spaced apart from one another in the direction of relative thermal expansion and contraction caused motion of said exhaust manifold;

said cylinder head means including connecting surfaces thereon placed such that a respective said exhaust manifold flange is secured thereagainst; each said flange being applied against the respective said connecting surface;

a compression strap over and across each said flange lug pair on the surface of said lug pairs away from the respective said connecting surface; there is at least one said compression strap which extends over and across a respective said lug pair for all said flanges;

fastening means for securing said strap against each said flange and to said cylinder head means and for causing said strap to apply such force to said flange as to seal the connection of the respective said exhaust ports and pipe sockets, while permitting the thermal expansion and contraction caused lateral motion of each said flange with respect to its said connecting surface; said fastening means extending from said pressure strap between said lugs of each said lug pair; the spacing of said lugs of each said pair permitting said lugs and the respective said flange to move with respect to the respective said fastening means passing between said lug pair.

2. The device of claim 1, wherein there are two said lug pairs defined on each said flange, with each said lug pair of each said flange being along one respective side of said exhaust manifold.

3. The device of claim 2, wherein there is at least one respective said compression strap of a length and size to extend over and across all said flange lug pairs along one side of said exhaust manifold, and there is a respective said fastening means at each said lug pair.

4. The device of claim 2, wherein there are two said compression straps, each being of a length and size to extend over and across all said flange lug pairs along one side of said exhaust manifold, and there is a respective said fastening means at each said lug pair.

5. The device of claim 4, wherein said fastening means comprises a respective fastening screw extending from said strap through the space between each said lug pair and into said cylinder head means; said cylinder head means having a respective receiving opening therein for each said fastening screw.

6. The device of claim 5, wherein said fastening screw also passes through and across said strap and said fastening screw passes, said strap opening being of a size smaller than the spacing between the respective said flange lug pair for that said fastening screw.

7. The device of claim 2, wherein said fastening means comprises a respective fastening screw extending from said strap through the space between each said lug pair and into said cylinder head means; said cylinder head means having a respective receiving opening therein for each said fastening screw.

8. The device of claim 7, wherein said fastening screw also passes through and across said strap and said strap having an opening therethrough through which said fastening screw passes, said strap opening being of a size smaller than the spacing between the respective said flange lug pair for that said fastening screw.

9. The device of claim 8, wherein said opening through said pressure strap for said fastening screw is about one half the width of the space between the respective said flange pair for that said fastening screw.

10. The device of claim 7, wherein said cylinder head means comprises a single cylinder head having a plurality of cylinders defined therein, with each said cylinder having a respective exhaust port therefrom.

11. The device of claim 10, wherein said internal combustion engine is a multi-cylinder, in-line internal combustion engine, with all exhaust ports thereof being arranged in a line.

* * * * *